US010392040B2

(12) United States Patent
Oswald et al.

(10) Patent No.: US 10,392,040 B2
(45) Date of Patent: Aug. 27, 2019

(54) SYSTEMS AND METHODS FOR DETERMINING TRACK LOCATION AND/OR DIRECTION OF TRAVEL

(71) Applicant: Westinghouse Air Brake Technologies Corporation, Wilmerding, PA (US)

(72) Inventors: James A. Oswald, Coggon, IA (US); Jeffrey D. Kernwein, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 261 days.

(21) Appl. No.: 15/382,922

(22) Filed: Dec. 19, 2016

(65) Prior Publication Data

US 2018/0170415 A1 Jun. 21, 2018

(51) Int. Cl.
*B61L 25/02* (2006.01)
*B61L 15/00* (2006.01)

(52) U.S. Cl.
CPC ..... *B61L 25/025* (2013.01); *B61L 15/0027* (2013.01); *B61L 25/021* (2013.01); *B61L 25/023* (2013.01); *B61L 25/028* (2013.01); *B61L 2205/04* (2013.01)

(58) Field of Classification Search
CPC ..... B61L 25/00; B61L 25/02; B61L 25/023; B61L 25/028; B61L 25/04; B61L 25/06; B61L 27/00; B61L 27/04
See application file for complete search history.

(56) References Cited

U.S. PATENT DOCUMENTS

| | | | |
|---|---|---|---|
| 5,129,605 | A | 7/1992 | Burns et al. |
| 6,218,961 | B1 | 4/2001 | Gross et al. |
| 6,311,109 | B1 | 10/2001 | Hawthorne et al. |
| 6,360,998 | B1 | 3/2002 | Halvorson et al. |
| 6,373,403 | B1 | 4/2002 | Korver et al. |
| 6,374,184 | B1 | 4/2002 | Zahm et al. |
| 6,456,937 | B1 | 9/2002 | Doner et al. |
| 6,480,766 | B2 | 11/2002 | Hawthorne et al. |
| 6,490,523 | B2 | 12/2002 | Doner |
| 6,542,809 | B2 | 4/2003 | Hehls, III |
| 6,641,090 | B2 | 11/2003 | Meyer |
| 6,865,454 | B2 | 3/2005 | Kane et al. |
| 6,996,461 | B2 | 2/2006 | Kane et al. |
| 7,079,926 | B2 | 7/2006 | Kane et al. |
| 7,142,982 | B2 | 11/2006 | Hickenlooper et al. |
| 7,805,227 | B2 | 9/2010 | Welles et al. |

(Continued)

*Primary Examiner* — Robert J McCarry, Jr.
(74) *Attorney, Agent, or Firm* — The Webb Law Firm

(57) ABSTRACT

A system and method for determining a track location and/or a direction of travel of a train includes at least one computer programmed or configured to determine at least one of a track on which the train is located and a direction of travel of the train on the track based at least partly on at least one location associated with at least one locomotive or control car of the train and at least one other location associated with at least one other locomotive or control car of the train. The at least one computer can be programmed or configured to determine a track on which the train is located based at least partly on the at least one location associated with the at least one locomotive or control car of the train and at least one additional location associated with at least one additional locomotive or control car of at least one additional train.

24 Claims, 6 Drawing Sheets

(56) References Cited

U.S. PATENT DOCUMENTS

| | | | | |
|---|---|---|---|---|
| 8,214,091 | B2 | 7/2012 | Kernwein | |
| 8,924,066 | B2 | 12/2014 | Fries | |
| 9,296,402 | B2 * | 3/2016 | Backes | B61L 23/10 |
| 2001/0044695 | A1 | 11/2001 | Doner | |
| 2005/0065726 | A1 | 3/2005 | Meyer et al. | |
| 2006/0253233 | A1 | 11/2006 | Metzger | |
| 2006/0271291 | A1 | 11/2006 | Meyer | |
| 2008/0231506 | A1 | 9/2008 | Stull et al. | |
| 2009/0105893 | A1 | 4/2009 | Kernwein | |
| 2012/0133553 | A1 | 5/2012 | Schmidt-Karaca et al. | |
| 2016/0355199 | A1 | 12/2016 | Kernwein et al. | |

* cited by examiner

SYSTEMS AND METHODS FOR DETERMINING TRACK LOCATION AND/OR DIRECTION OF TRAVEL

BACKGROUND OF THE INVENTION

Field of the Invention

This invention relates generally to a system and method for determining the position or location and/or direction of travel of vehicles in a transit network and, in particular, to a system and method for determining a track location and/or a direction of travel of a train or locomotive in a track network made up of multiple interconnected tracks.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. In order to effectively manage all of the trains, navigation and enforcement systems and processes are implemented, both at the train level and the central dispatch level.

Existing PTC systems and processes can utilize a global positioning system (GPS) to determine a location or position of a locomotive or control car. However, GPS position reports tend to drift around within an accuracy bubble over time and space. The location or position information from a single locomotive is typically not accurate enough to distinguish which track the locomotive is on when in an area with multiple parallel or crossing tracks, for example, in a train yard including ladder tracks. For example, with a GPS accuracy of about 10 ft. (shown by the circles in FIG. 3) and a minimum track spacing of 14 ft., a single position report from a locomotive can leave ambiguity in determining on which track a locomotive is located. As shown in the example in FIG. 3, position X, associated with Locomotive 1, is actually closer to Track B than Track A. Thus it is ambiguous, based on position X, if Locomotive 1 is on Track A or Track B. Accordingly, crew input, such as an operator of the train indicating on which track the train is located and the current direction of travel of the train, may be required to confirm the track location and/or the direction of travel of the Locomotive 1. Crew interaction and input, however, lowers a safety aspect of the PTC system because it allows for human error to be introduced.

For at least these reasons, there is a need in the art for an improved system and method for determining a track location and a direction of travel of a train.

SUMMARY OF THE INVENTION

Generally, provided are an improved system and computer-implemented method for determining a track location and a direction of travel of a train, preferably for use in connection with trains located in a track network. Preferably, provided are a system and computer-implemented method that reduce a crew interaction requirement of PTC systems. Preferably, provided are a system and computer-implemented method that can reduce uncertainty associated with a track location and/or a direction of travel of a train determined based on GPS position reports. Preferably, provided are a system and computer-implemented method for determining a track location and a direction of travel of a train that enable the track location and the direction of travel of the train to be determined with greater accuracy, provide improved safety for train and other vehicles in the transit network, and enable PTC systems to protect the train at an earlier time.

According to one preferred and non-limiting embodiment or aspect, provided is a system for determining a track location of a train including at least two locomotives or control cars and, optionally, at least one railroad car, in a track network having a plurality of tracks, the system comprising at least one computer programmed or configured to: receive or determine at least one location associated with at least one locomotive or control car of the train; receive or determine at least one other location associated with at least one other locomotive or control car of the train; and determine a track of the plurality of tracks on which the train is located based at least partly on the at least one location associated with the at least one locomotive and the at least one other location associated with the at least one other locomotive.

In one preferred and non-limiting embodiment, the at least one computer is programmed or configured to: determine a distribution of the at least one location associated with the at least one locomotive and the at least one other location associated with the at least one other locomotive and normalize the distribution to track centerline data; and determine the track of the plurality of tracks on which the train is located based at least partly on the normalized distribution.

In one preferred and non-limiting embodiment, the at least one location associated with the at least one locomotive of the train comprises a plurality of locations associated with the at least one locomotive of the train over a period of time.

In one preferred and non-limiting embodiment, the at least one other locomotive of the train comprises a plurality of other locomotives of the train, and wherein the at least one other location comprises a plurality of other locations associated with the plurality of other locomotives of the train over a period of time.

In one preferred and non-limiting embodiment, the at least one locomotive is a lead locomotive, and wherein the at least one computer is programmed or configured to: receive or determine a direction of orientation of the lead locomotive on the track; receive or determine a reverser handle position of the lead locomotive; and determine based on the direction of orientation and the reverser handle position a direction of travel of the train on the track.

In one preferred and non-limiting embodiment, the at least one computer is programmed or configured to: receive or determine at least one additional location associated with at least one additional locomotive or control car of at least one additional train in the track network; and determine the track of the plurality of tracks on which the train is located based at least partly on the at least one additional location associated with the at least one additional locomotive of the at least one additional train in the track network.

In one preferred and non-limiting embodiment, the at least one computer is programmed or configured to: determine, based at least partly on the at least one additional location associated with the at least one additional locomotive of the at least one additional train in the track network, an amount of skew associated with the at least one location of the at least one locomotive of the train and/or the at least one other location of the at least one other locomotive of the train; and adjust the at least one location associated with the at least one locomotive and/or the at least one other location associated with the at least one other locomotive based on the determined skew.

In one preferred and non-limiting embodiment, the at least one additional location associated with the at least one additional locomotive of the at least one additional train comprises a plurality of additional locations associated with the at least one additional locomotive of the at least one additional train over a period of time.

In one preferred and non-limiting embodiment, the at least one computer is programmed or configured to: identify the at least one additional locomotive of the at least one additional train in the track network based on a distance of the at least one additional locomotive of the at least one additional train from the at least one locomotive of the train.

In one preferred and non-limiting embodiment, the track of the plurality of tracks on which the train is located comprises a first track connected to a second track by at least one switch, and wherein the at least one computer is programmed or configured to: determine an alignment of the at least one switch based at least partly on a position of the at least one first locomotive in the train, a position of the at least one second locomotive in the train, the at least one location associated with the at least one locomotive, and the at least one other location associated with the at least one other locomotive.

In one preferred and non-limiting embodiment, the at least one computer comprises an onboard computer of the at least one locomotive or control car, the onboard computer programmed or configured to: transmit a query message to at least one of (i) the least one other locomotive or control car of the train and (ii) a back office server, the query message requesting a locomotive position report message including the at least one other location associated with at least one other locomotive or control car of the train.

In one preferred and non-limiting embodiment, the system further comprises a positioning system onboard the at least one locomotive or control car of the train, the positioning system comprising a Global Positioning System (GPS) programmed or configured to determine the at least one location associated with at least one locomotive or control car of the train.

According to one preferred and non-limiting embodiment or aspect, provided is a system for determining a direction of travel of a train including at least two locomotives or control cars and, optionally, at least one railroad car, in a track network having a plurality of tracks, the system comprising at least one computer programmed or configured to: receive or determine a direction of orientation of a lead locomotive of the train on the track; receive or determine a reverser handle position of the lead locomotive of the train; and determine based on the direction of orientation and the reverser handle position the direction of travel of the train on the track.

According to one preferred and non-limiting embodiment or aspect, provided is a computer implemented method for determining a track location of a train including at least two locomotives or control cars and, optionally, at least one railroad car, in a track network having a plurality of tracks, the method comprising: receiving or determining at least one location associated with at least one locomotive of the train; receiving or determining at least one other location associated with at least one other locomotive of the train; and determining a track of the plurality of tracks on which the train is located based at least partly on the at least one location associated with the at least one locomotive and the at least one other location associated with the at least one other locomotive.

According to one preferred and non-limiting embodiment or aspect, provided is a computer implemented method for determining a direction of travel of a train including at least two locomotives or control cars and, optionally, at least one railroad car, in a track network having a plurality of tracks, the method comprising: receiving or determining a direction of orientation of a lead locomotive of the train on the track; receiving or determining a reverser handle position of the lead locomotive of the train; and determining based on the direction of orientation and the reverser handle position the direction of travel of the train on the track.

According to one preferred and non-limiting embodiment or aspect, provided is a system for determining a track location of a train including at least one locomotive or control car and, optionally, at least one railroad car, in a track network having a plurality of tracks, the system comprising at least one computer programmed or configured to: receive or determine at least one location associated with the at least one locomotive of the train; receive or determine at least one additional location associated with at least one additional locomotive or control car of at least one additional train in the track network; and determine a track of the plurality of tracks on which the train is located based at least partly on the at least one location associated with the at least one locomotive of the train and the at least one additional location associated with the at least one additional locomotive of the at least one additional train.

In one preferred and non-limiting embodiment or aspect, the at least one computer is programmed or configured to: determine, based on the at least one additional location associated with the at least one additional locomotive of the at least one additional train in the track network, an amount of skew associated with the at least one location of the at least one locomotive of the train; and adjust the at least one location associated with the at least one locomotive of the train based on the determined skew.

In one preferred and non-limiting embodiment or aspect, the at least one additional location associated with the at least one additional locomotive of the at least one additional train comprises a plurality of additional locations associated with the at least one additional locomotive of the at least one additional train over a period of time.

In one preferred and non-limiting embodiment or aspect, the at least one additional locomotive of the at least one additional train comprises a plurality of additional locomotives.

In one preferred and non-limiting embodiment or aspect, the at least one computer is programmed or configured to: identify the at least one additional locomotive of the at least one additional train in the track network based on a distance of the at least one additional locomotive of the at least one additional train from the at least one locomotive of the train.

In one preferred and non-limiting embodiment or aspect, the train comprises at least one other locomotive, and wherein the at least one computer is programmed or configured to: receive or determine at least one other location associated with the at least one other locomotive of the train; and determine the track of the plurality of tracks on which the train is located based at least partly on the at least one other location associated with the at least one other locomotive.

In one preferred and non-limiting embodiment or aspect, the at least one computer comprises an onboard computer of the at least one locomotive or control car, the onboard computer programmed or configured to: transmit a query message to at least one of (i) the least one additional locomotive or control car of the at least one additional train in the track network and (ii) a back office server, the query message requesting a locomotive position report message including the at least one additional location associated with at least one additional locomotive or control car of the at least one additional train.

In one preferred and non-limiting embodiment or aspect, the system further comprises a positioning system onboard the at least one locomotive or control car of the train, the positioning system comprising a Global Positioning System (GPS) programmed or configured to determine the at least one location associated with at least one locomotive or control car of the train.

According to a preferred and non-limiting embodiment or aspect, provided is a computer implemented method for determining a track location of a train including at least one locomotive or control car and, optionally, at least one railroad car, in a track network having a plurality of tracks, the method comprising: receiving or deter mining at least one location associated with the at least one locomotive of the train; receiving or determining at least one additional location associated with at least one additional locomotive or control car of at least one additional train in the track network; and determining a track of the plurality of tracks on which the train is located based at least partly on the at least one location associated with the at least one locomotive of the train and the at least one additional location associated with the at least one additional locomotive of the at least one additional train.

Other preferred and non-limiting embodiments or aspects of the present invention will be set forth in the following numbered clauses:

Clause 1. A system for determining a track location of a train including at least two locomotives or control cars and, optionally, at least one railroad car, in a track network having a plurality of tracks, the system comprising at least one computer programmed or configured to: receive or determine at least one location associated with at least one locomotive or control car of the train; receive or determine at least one other location associated with at least one other locomotive or control car of the train; and determine a track of the plurality of tracks on which the train is located based at least partly on the at least one location associated with the at least one locomotive and the at least one other location associated with the at least one other locomotive.

Clause 2. The system of clause 1, wherein the at least one computer is programmed or configured to: determine a distribution of the at least one location associated with the at least one locomotive and the at least one other location associated with the at least one other locomotive and normalize the distribution to track centerline data; and determine the track of the plurality of tracks on which the train is located based at least partly on the normalized distribution.

Clause 3. The system of clause 1 or 2, wherein the at least one location associated with the at least one locomotive of the train comprises a plurality of locations associated with the at least one locomotive of the train over a period of time.

Clause 4. The system of any of clauses 1-3, wherein the at least one other locomotive of the train comprises a plurality of other locomotives of the train, and wherein the at least one other location comprises a plurality of other locations associated with the plurality of other locomotives of the train over a period of time.

Clause 5. The system of any of clauses 1-4, wherein the at least one locomotive is a lead locomotive, and wherein the at least one computer is programmed or configured to: receive or determine a direction of orientation of the lead locomotive on the track; receive or determine a reverser handle position of the lead locomotive; and determine based on the direction of orientation and the reverser handle position a direction of travel of the train on the track.

Clause 6. The system of any of clauses 1-5, wherein the at least one computer is programmed or configured to: receive or determine at least one additional location associated with at least one additional locomotive or control car of at least one additional train in the track network; and determine the track of the plurality of tracks on which the train is located based at least partly on the at least one additional location associated with the at least one additional locomotive of the at least one additional train in the track network.

Clause 7. The system of any of clauses 1-6, wherein the at least one computer is programmed or configured to: determine, based at least partly on the at least one additional location associated with the at least one additional locomotive of the at least one additional train in the track network, an amount of skew associated with the at least one location of the at least one locomotive of the train and/or the at least one other location of the at least one other locomotive of the train; and adjust the at least one location associated with the at least one locomotive and/or the at least one other location associated with the at least one other locomotive based on the determined skew.

Clause 8. The system of any of clauses 1-7, wherein the at least one additional location associated with the at least one additional locomotive of the at least one additional train comprises a plurality of additional locations associated with the at least one additional locomotive of the at least one additional train over a period of time.

Clause 9. The system of any of clauses 1-8, wherein the at least one computer is programmed or configured to: identify the at least one additional locomotive of the at least one additional train in the track network based on a distance of the at least one additional locomotive of the at least one additional train from the at least one locomotive of the train.

Clause 10. The system of any of clauses 1-9, wherein the track of the plurality of tracks on which the train is located comprises a first track connected to a second track by at least one switch, and wherein the at least one computer is programmed or configured to: determine an alignment of the at least one switch based at least partly on a position of the at least one first locomotive in the train, a position of the at least one second locomotive in the train, the at least one location associated with the at least one locomotive, and the at least one other location associated with the at least one other locomotive.

Clause 11. The system of any of clauses 1-10, wherein the at least one computer comprises an onboard computer of the at least one locomotive or control car, the onboard computer programmed or configured to: transmit a query message to at least one of (i) the least one other locomotive or control car of the train and (ii) a back office server, the query message requesting a locomotive position report message including the at least one other location associated with at least one other locomotive or control car of the train.

Clause 12. The system of any of clauses 1-11, further comprising a positioning system onboard the at least one locomotive or control car of the train, the positioning system comprising a Global Positioning System (GPS) programmed or configured to determine the at least one location associated with at least one locomotive or control car of the train.

Clause 13. A system for determining a direction of travel of a train including at least two locomotives or control cars and, optionally, at least one railroad car, in a track network having a plurality of tracks, the system comprising at least one computer programmed or configured to: receive or determine a direction of orientation of a lead locomotive of the train on the track; receive or determine a reverser handle position of the lead locomotive of the train; and determine based on the direction of orientation and the reverser handle position the direction of travel of the train on the track.

Clause 14. A computer implemented method for determining a track location of a train including at least two locomotives or control cars and, optionally, at least one railroad car, in a track network having a plurality of tracks, the method comprising: receiving or determining at least one location associated with at least one locomotive of the train; receiving or determining at least one other location associated with at least one other locomotive of the train; and determining a track of the plurality of tracks on which the train is located based at least partly on the at least one location associated with the at least one locomotive and the at least one other location associated with the at least one other locomotive.

Clause 15. A computer implemented method for determining a direction of travel of a train including at least two locomotives or control cars and, optionally, at least one railroad car, in a track network having a plurality of tracks, the method comprising: receiving or determining a direction of orientation of a lead locomotive of the train on the track; receiving or determining a reverser handle position of the lead locomotive of the train; and determining based on the direction of orientation and the reverser handle position the direction of travel of the train on the track.

Clause 16. A system for determining a track location of a train including at least one locomotive or control car and, optionally, at least one railroad car, in a track network having a plurality of tracks, the system comprising at least one computer programmed or configured to: receive or determine at least one location associated with the at least one locomotive of the train; receive or determine at least one additional location associated with at least one additional locomotive or control car of at least one additional train in the track network; and determine a track of the plurality of tracks on which the train is located based at least partly on the at least one location associated with the at least one locomotive of the train and the at least one additional location associated with the at least one additional locomotive of the at least one additional train.

Clause 17. The system of clause 16, wherein the at least one computer is programmed or configured to: determine, based on the at least one additional location associated with the at least one additional locomotive of the at least one additional train in the track network, an amount of skew associated with the at least one location of the at least one locomotive of the train; and adjust the at least one location associated with the at least one locomotive of the train based on the determined skew.

Clause 18. The system of clause 16 or 17, wherein the at least one additional location associated with the at least one additional locomotive of the at least one additional train comprises a plurality of additional locations associated with the at least one additional locomotive of the at least one additional train over a period of time.

Clause 19. The system of any of clauses 16-18, wherein the at least one additional locomotive of the at least one additional train comprises a plurality of additional locomotives.

Clause 20. The system of any of clauses 16-19, wherein the at least one computer is programmed or configured to: identify the at least one additional locomotive of the at least one additional train in the track network based on a distance of the at least one additional locomotive of the at least one additional train from the at least one locomotive of the train.

Clause 21. The system of any of clauses 16-20, wherein the train comprises at least one other locomotive, and wherein the at least one computer is programmed or configured to: receive or determine at least one other location associated with the at least one other locomotive of the train; and determine the track of the plurality of tracks on which the train is located based at least partly on the at least one other location associated with the at least one other locomotive.

Clause 22. The system of any of clauses 16-21, wherein the at least one computer comprises an onboard computer of the at least one locomotive or control car, the onboard computer programmed or configured to: transmit a query message to at least one of (i) the least one additional locomotive or control car of the at least one additional train in the track network and (ii) a back office server, the query message requesting a locomotive position report message including the at least one additional location associated with at least one additional locomotive or control car of the at least one additional train.

Clause 23. The system of any of clauses 16-22, further comprising a positioning system onboard the at least one locomotive or control car of the train, the positioning system comprising a Global Positioning System (GPS) programmed or configured to determine the at least one location associated with at least one locomotive or control car of the train.

Clause 24. A computer implemented method for determining a track location of a train including at least one locomotive or control car and, optionally, at least one railroad car, in a track network having a plurality of tracks, the method comprising: receiving or determining at least one location associated with the at least one locomotive of the train; receiving or determining at least one additional location associated with at least one additional locomotive or control car of at least one additional train in the track network; and determining a track of the plurality of tracks on which the train is located based at least partly on the at least one location associated with the at least one locomotive of the train and the at least one additional location associated with the at least one additional locomotive of the at least one additional train.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
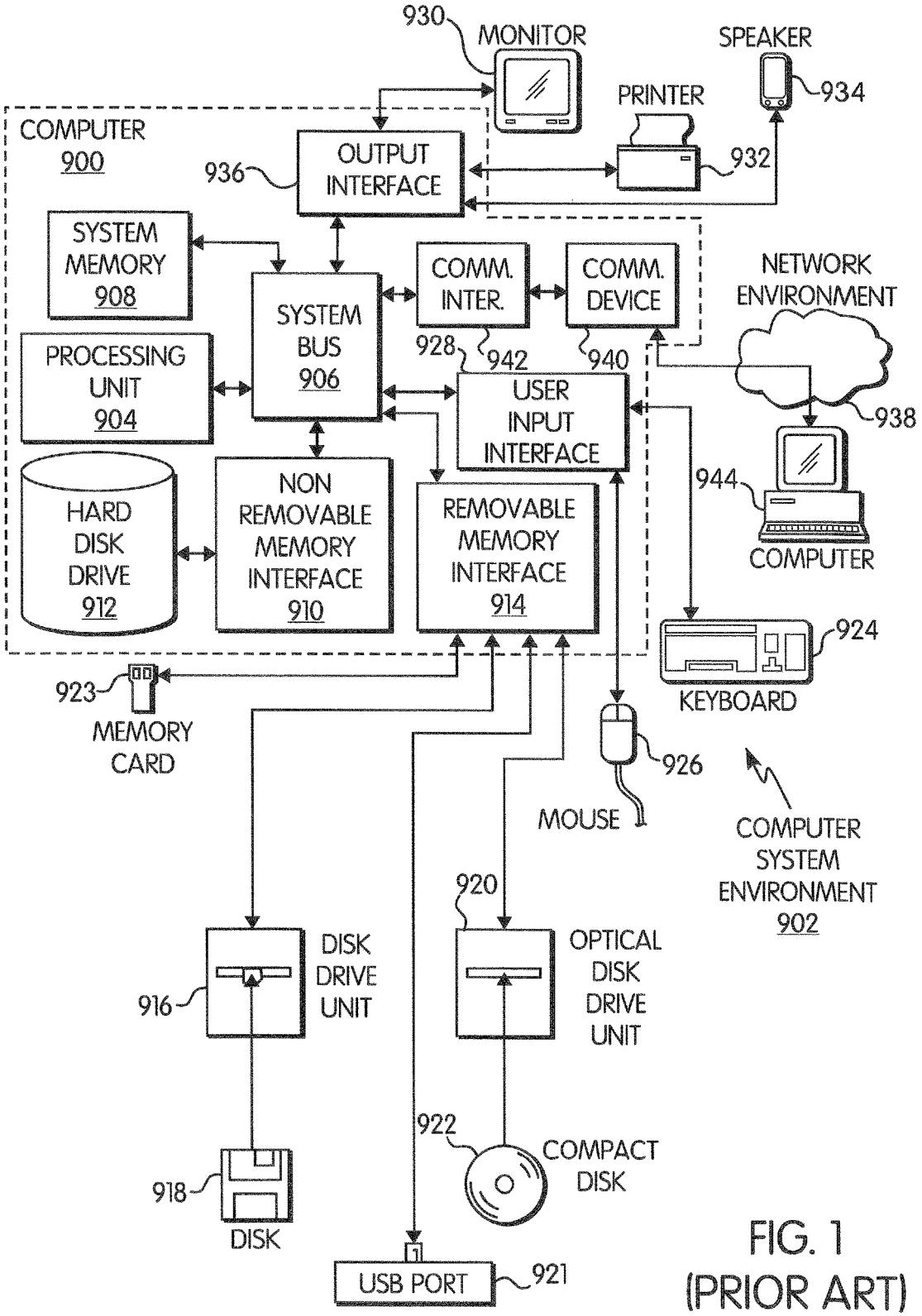
FIG. 1 (PRIOR ART)
FIG. 1 is a schematic view of a computer system and environment according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track, over a trainline extending between railcars of a train, and the like)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The system and computer-implemented method for determining a track location and a direction of travel described herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR). It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight train, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist.

In one preferred and non-limiting embodiment or aspect, the methods and systems described herein are used in connection with the locomotives or controls cars (L) that are positioned on each end of the train (TR), while in other preferred and non-limiting embodiments or aspects, the methods and systems described herein are used in connection with locomotives or control cars (L) that are positioned intermediately in the train (TR) (since these intermediate locomotives or control cars (L) may eventually become a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight trains, push-pull train configurations, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

As shown in FIG. 1, and according to the prior art, personal computers 900, 944, in a computing system environment 902 may be provided or utilized, such as in connection with the on-board computer described below. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the sole exception of transitory, propagating signals. Of course, combinations of any of the above should also be included within the scope of computer-readable media.

As seen in FIG. 1, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 1, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 902, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 1 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB) 921. Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communicate through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

As discussed hereinafter, the system and method for determining a track location and a direction of travel of the present invention may be implemented by, programmed or configured on, or otherwise associated with any type of computer or processor, such as one or more of the following: a specially-programmed computer, an on-board controller, an on-board computer 10 (as discussed hereinafter), a train management computer, a remote server, a back office server 23, a wayside device, a PTC component, a networked computer, or any combination thereof. Accordingly, some or all of the steps in the system, process, and method discussed hereinafter may be implemented and/or executed on-board a locomotive or control car (L), and similarly, some or all of the steps in the system, process, and method discussed hereinafter may be implemented and/or executed by a computer or processor that is remote from the train (TR), where the remote computer or processor is in direct or indirect communication with a communication device 12 of the train (TR).

Figure 2A:
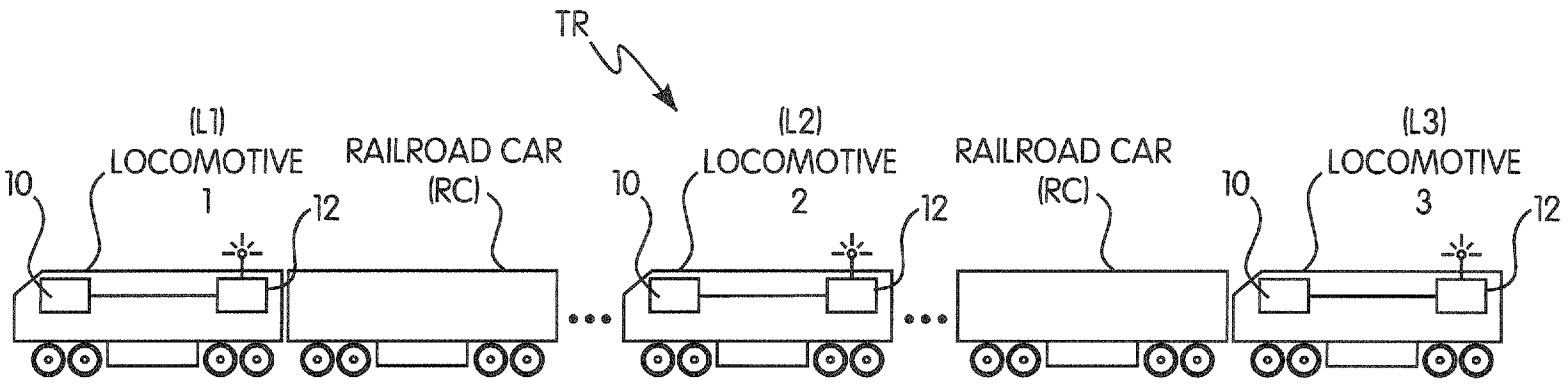
FIG. 2A is a schematic view of a system for determining track location and direction of travel according to the principles of the present invention.
Figure 2B:
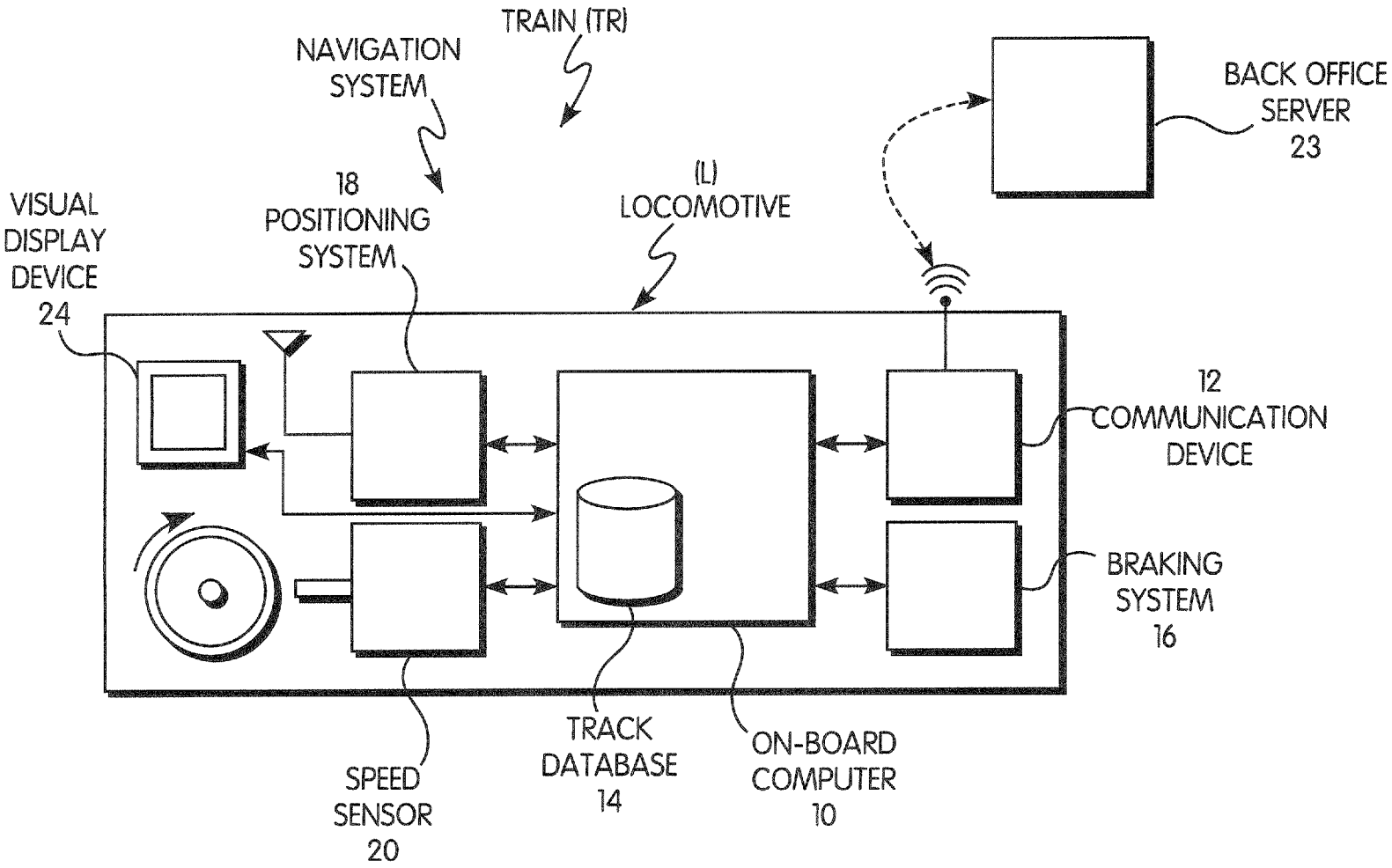
FIG. 2B is a schematic view of one embodiment of a system for determining track location and direction of travel according to the principles of the present invention.

With specific reference to FIGS. 2A and 2B, and in one preferred and non-limiting embodiment or aspect, provided is a system for determining a track location and a direction of travel for a train (TR) including at least one locomotive or control car (L) and, optionally, one or more railcars (RC). For example, in one implementation, the train (TR) may include a plurality of locomotives (L1, L2, L3) and a plurality of rail cars (RC). In another implementation, the train (TR) may include only a single locomotive (L) and no rail cars (RC). The locomotive(s) (L) are equipped with at least an on-board computer 10 (e.g., an on-board controller, a train management computer, an on-board processor, and/or the like) programmed or configured to implement or facilitate at least one train action and a communication device 12 in communication with the on-board computer 10 and programmed or configured to receive, transmit, and/or process data signals. While the communication device 12 may be in the form of a wireless communication device (as illustrated in FIG. 2B), as discussed herein, this communication device 12 may also be programmed or configured to transmit, process, and/or receive signals over a trainline, using an ECP component, over the rails, and/or the like.

The system architecture used to support the functionality of at least some of the methods and systems described herein includes: the train management computer or on-board computer 10 (which performs calculations for or within the Positive Train Control (PTC) system, including navigation and enforcement calculations); the communication device 12 (or data radio) (which may be used to facilitate the communications between the on-board computers 10 in one or more of the locomotives or control cars (L) of a train (TR), communications with a wayside device, e.g., signals, switch monitors, wayside devices, and the like, and/or communications with a remote server, e.g., a back office server 23, a central controller, central dispatch, and/or); a track database 14 (which may include information about track positions or locations, switch locations, crossing locations, track heading changes, e.g., curves, distance measurements, train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like); a navigation system 16 (optionally including a positioning system 18 (e.g., a Global Positioning System (GPS)) and/or a wheel tachometer/speed sensor 20), such as in a PTC-equipped locomotive or control car (L); and a visual display device 24 (or operator interface), typically located in the locomotive or control car (L), which is in direct or indirect communication with the on-board computer 10 and provides information and data to the operator, such as the information, data, and/or screens as discussed hereinafter. It should also be recognized that some or all of the steps and processing described herein may be performed locally by the on-board computer 10 of the locomotive or control car (L), or alternatively, by another computer (e.g., a computer associated with the end-of-train unit, a computer associated with a wayside device, and the like) and/or a remote computer or server (e.g., the back office server 23, a remote computer or server associated with central dispatch, a central controller, a computer-aided dispatch system, and intermediate control computer, and the like).

Further, and as discussed, the on-board computer 10 includes or is in communication with the communication device 12 (e.g., a data radio, a communication interface, a communication component, and/or the like), which facilitates communication by or between locomotives or control cars (L) and/or the locomotive or control car (L) and some remote server or computer system, e.g., a central controller, a back office server 23, a remote server, central dispatch, back office PTC components, various wayside devices, such as signal or switch monitors, or other on-board computers 10 in the railway system. Further, this communication may occur wirelessly or in a "hard wired" form, e.g., over the rails of the track.

As discussed, the on-board computer 10 may be located at any position or orientation on the train (TR), and the on-board computer 10 (or on-board controller, on-board computer system, train management computer, and/or the like, and which performs the determinations and/or calculations for the Positive Train Control (PTC) system) includes or is in communication with the track database 14 populated with data and/or which receives specified data and information from other trains, remote servers, back office servers 23, central dispatch, and/or the like, where this data may include track profile data, train data, information about switch locations, track heading changes (e.g., curves, and distance measurements), train consist information (e.g., the number of locomotives, the number of cars, the total length of the train (TR)), and/or the like. Of course, it is envisioned that any type of train management system can be used within the context and scope of the present invention.

Figure 3:
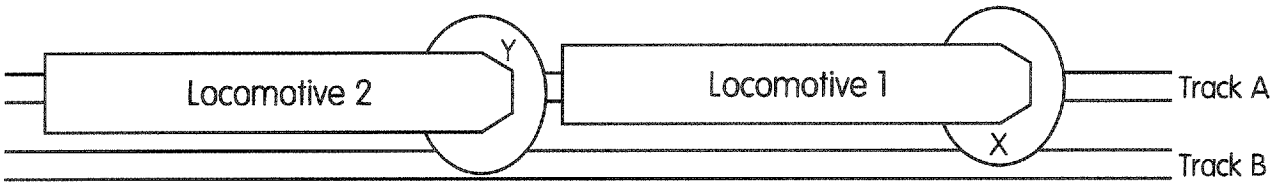
FIG. 3 is a schematic view of a train in an example track network according to principles of the present invention.

FIG. 3 is a schematic view of a train in an example track network according to principles of the present invention. A system and computer-implemented method for determining a track location and/or a direction of travel of a train (TR) including at least two locomotives or control cars (L1, L2) and, optionally, at least one railroad car (RC), in a track network having a plurality of tracks (Track A, Track B) includes at least one computer, which as discussed herein can include one or more of the following: a specially-programmed computer, an on-board controller, an on-board computer 10 (as discussed hereinafter), a train management computer, a remote server, a back office server, a wayside device, a PTC component, a networked computer, or any combination thereof. In some examples, the track network may comprise a network of ladder tracks. The at least one computer is programmed or configured to receive or determine at least one location associated with at least one locomotive or control car of the train, and receive or determine at least one other location associated with at least one other locomotive or control car of the train. For example, the onboard computer 10 of a locomotive or a remote computer, such as, the back office server 23, can receive GPS position reports including location information, such as, GPS coordinates, from the positioning system 18 onboard the locomotives (L1, L2) of the train (TR). The communication device 12 of the locomotives (L1, L2) can transmit position reports to the other locomotives (L1, L2) in the train (TR), to other locomotives in other trains, and/or to the back office server 23. The back office server 23 can transmit the position reports received from a locomotive in the train (TR) to the other locomotives in the train (TR) and/or to the other locomotives in the other trains. Location information associated with locomotives in the track network can thus be shared between the locomotives, the back office server 23, and/or other computing devices in a PTC system.

The at least one computer is programmed or configured to determine at least one of a track of the plurality of tracks on which the train (TR) is located and a direction of travel of the train (TR) on the track based at least partly on the at least one location associated with the at least one locomotive and the at least one other location associated with the at least one other locomotive. For example, the onboard computer 10 of one or more of the locomotives (L1, L2) and/or a remote computer, such as, the back office server 23, can analyze the position information from multiple locomotives (L1, L2) coupled in the same train (TR) or consist to determine a track on which the train (TR) is located. The onboard computer 10 of one or more of the locomotives (L1, L2) and/or a remote computer, such as, the back office server 23, can determine based on consist information, such as, as consist message or position report form the Locomotive 2, that the Locomotive 2 is in the same train (TR) or consist as the Locomotive 1. The back office server 23 can receive information including the position of each locomotive (L) in the train (TR) from the central dispatch, e.g., a computer aided dispatch (CAD) system. The messages from the central dispatch include a field that indicates the position of each locomotive (L) in the train (TR). The back office server 23 can receive position reports from each locomotive (L) in the train (TR). The position reports include earth-centered, earth-fixed (ECEF) coordinates for the location of the locomotive (L) within the uncertainty of the GPS system.

As shown in the example of FIG. 3, position X, associated with Locomotive 1, is closer to Track B than Track A, even though Locomotive 1 is actually located on Track A. Accordingly, it is ambiguous, based only on the location information associated with Locomotive 1, i.e., position X, whether Locomotive 1 is on Track A or Track B. The at least one computer is programmed or configured to determine a distribution of the at least one location associated with the at least one locomotive and the at least one other location associated with the at least one other locomotive and normalize the distribution to track centerline data, and determine the track of the plurality of tracks on which the train is located based at least partly on the normalized distribution. For example, the onboard computer 10 of one or more of the locomotives (L1, L2) and/or a remote computer, such as, the back office server 23, can use the position Y, associated with Locomotive 2, in combination with the position X, associated with the Locomotive 1, to form a distribution of location information and normalize the distribution of the location information associated with the positions X and Y to track centerline data. The track centerline data may be stored in and retrieved from the track database 14 and/or the back office server 23 and includes at least data or information sufficient to determine the centerline C (i.e., the center between the rails along a section of track T) of the track T upon which the train (TR) is located or traversing. The onboard computer 10 of one or more of the locomotives (L1, L2) and/or a remote computer, such as, the back office server 23, can determine based on the normalized distribution that the train (TR) is on Track A and, thus, that the Locomotive 1 is on Track A.

For example, the onboard computer 10 of one or more of the locomotives (L1, L2) and/or a remote computer, such as, the back office server 23, can compare the positions of locomotives (L) known to be in the same train (TR) against track database information including the track centerline location and any switches within the track. The position(s) from any one locomotive (L) may be ambiguous in determining which track the locomotive (L) is on because an uncertainty of the position may allow the position to be valid for a vehicle on different tracks that are within close proximity. However, position reports from other locomotives (L) are distributed within their uncertainty. By combining the position reports from more than one locomotive (L), the onboard computer 10 of one or more of the locomotives (L1, L2) and/or a remote computer, such as, the back office server 23, can determine a normalized position that more clearly indicates the track that the train (TR) including the locomotive (L) occupies. For example, in FIG. 3, Locomotive 1 reports a position X which is ambiguous (due to uncertainty) as to whether the train is located on Track A or Track B. A vehicle on either track A or B could report that position. However, the position report Y from Locomotive 2 is too far from Track B (beyond uncertainty limits with respect to the track centerline of Track B) and, therefore, must be associated with a vehicle on Track A, because there are no other nearby tracks. By combining the information including the position of each locomotive (L) in the train (TR) received from the central dispatch, which indicates that Locomotive 1 and Locomotive 2 are in the same train, and utilizing a track database that indicates there are no switches on the track between Locomotive 1 and Locomotive 2, the location of Locomotive 1 can be determined to be on Track A, because the Locomotive is in the same train (TR) as the Locomotive 2 and the Locomotive 2 must be on Track A.

Figure 4:
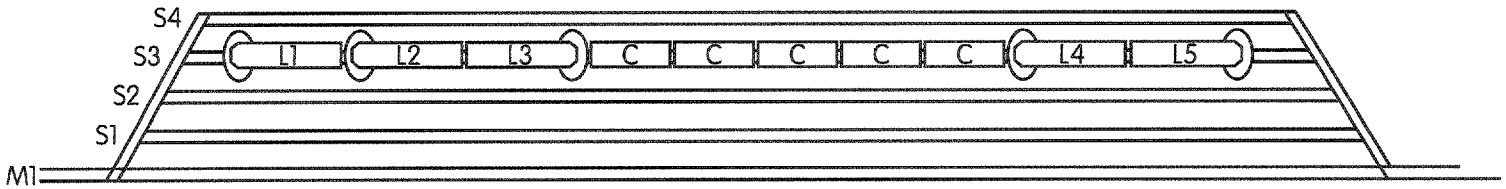
FIG. 4 is a schematic view of a train in an example track network according to principles of the present invention.

A greater number of locomotives, e.g., three or more locomotives (L1, L2, L3, L4, L5) as shown in FIG. 4, in a train (TR) enables the onboard computer 10 of one or more of the locomotives and/or a remote computer, such as, the back office server 23, to reduce an uncertainty associated with a track location determination by using positions associated with the greater number of locomotives to form the distribution and normalize the distribution to the track centerline data. For example, the greater number of locomotives enables the onboard computer 10 or back office server 23 to determine the normalized distribution based on a greater number of distribution points, which provides a greater accuracy in determining the track on which the train (TR) is located.

In one example, the at least one location associated with the at least one locomotive of the train comprises a plurality of locations associated with the at least one locomotive of the train over a period of time. For example, the onboard computer 10 of one or more of the locomotives (L1, L2) and/or a remote computer, such as, the back office server 23, can receive multiple GPS position reports including location information, such as, GPS coordinates, from the positioning system 18 onboard the same locomotive. The at least one other locomotive of the train can comprise a plurality of other locomotives of the train, and the at least one other location can comprise a plurality of other locations associated with the plurality of other locomotives of the train over a period of time. For example, the onboard computer 10 or back office server 23 can receive multiple position reports from some or all of the locomotives of a train (TR). The use of multiple position reports from the same locomotive to determine the distribution of location information can reduce the uncertainty associated with a track location determination because a GPS position of a stopped locomotive drifts around over time within an uncertainty bubble.

The at least one computer is programmed or configured to receive or determine a relative position of the at least one locomotive and the at least one other locomotive of the train on the track, receive or determine a direction of orientation of a lead locomotive of the train on the track, and determine based on the direction of orientation and the reverser handle position of the lead locomotive the direction of travel of the train on the track. For example, referring to FIG. 4, the onboard computer 10 of one or more of the locomotives (L1, L2, L3, L4, L5) and/or a remote computer, such as, the back office server 23, can receive or determine consist information indicating the position of the locomotives (L1, L2, L3, L4, L5) in the train (TR) or consist and a direction of orientation of the lead locomotives (L1) in the train (TR). The onboard computer 10 of one or more of the locomotives (L1, L2, L3, L4, L5) and/or a remote computer, such as, the back office server 23, can receive the orientation the lead (controlling) locomotive (L1) of the train (TR) from the CAD. The orientation of the lead (controlling) locomotive (L1) is either 1 for a front orientation or 2 for a back orientation. The crew can confirm the orientation when reviewing and accepting the consist. The orientation of the lead locomotive (L1) can be used to determine which direction the train (TR) will move when the lead (controlling) locomotive (L1) direction handle is in a forward or reverse position. When a consist message is received (from the back office server 23 or another locomotive) by the onboard computer 10 of a locomotive during initialization of the locomotive, any other locomotives in the train (TR) in which the locomotive is located can be known by the onboard computer 10 from the consist message. The onboard computer 10 of the controlling locomotive in the train (TR) can request/gather locomotive position report messages from the other locomotives in the train (TR) or consist. For example, the onboard computer 10 can issue a new query message (locomotive-to-locomotive) or query the back office server 23 for the recent location information of the locomotives in the train (TR). A group of the most recent position reports for each locomotive, e.g., about three position reports, can be sent to provide a better distribution for the analysis to determine the track on which the train (TR) is located.

The onboard computer 10 of one or more of the locomotives (L1, L2, L3, L4, L5) and/or a remote computer, such as, the back office server 23, can determine the direction of travel of the train (TR) by comparing the position of the locomotives in the train. For example, the locomotive orientations and a reverser handle position of the lead locomotive (L1) can be determined from the consist information, and the onboard computer 10 of one or more of the locomotive (L1, L2, L3, L4, L5)) and/or a remote computer, such as, the back office server 23, can determine the direction of travel of the train (TR) without the train needing to move the train to determine the direction of travel, which can improve safety and enable the PTC system to protect the train earlier. The position reports from multiple locomotives (L) known to be in the same train can be used to determine a direction of travel for the train. The consist information provides the position of each locomotive in the train with the lead locomotive (L1) being at position 1. By comparing the positions of each locomotive in the same train after translating them to a track location, a direction of travel is determined. For example, in FIG. 4, knowing that locomotive L1 is in position 1 and L5 is in position 10, and having position reports from each the direction of travel for the train can be determined that forward movement would be from L5 towards L1.

As shown in the example of FIG. 4, by analyzing the locomotive position data of the train (TR), the onboard computer 10 of one or more of the locomotives (L1, L2, L3, L4, L5) and/or a remote computer, such as, the back office server 23, can determine that the train (TR) including the locomotives (L1, L2, L3, L4, L5) is on Siding 3, with Locomotive 1 being the lead locomotive, and that the direction of travel would be to the left if the Locomotive 1 were throttled up and the reverser handle was in the forward position. Direction of travel is train (TR) specific. A step in determining direction of movement of the train is to couple the direction of travel with the orientation and reverser handle position of the lead locomotive (L1) to determine which way the train (TR) will move before the train (TR) moves. For example, in FIG. 4, position information from L1 and L5 can enable a determination that forward direction of travel for the train will be from L5 towards L1. From the consist information, the orientation of the lead locomotive (L1) is provided. If the orientation of the lead locomotive (L1) is front and the handle position is forward or if the orientation of the lead locomotive (L1) is back and handle position is reverse, the train's direction of movement will be from L5 towards L1. Conversely, if the orientation of the lead locomotive (L1) is front and handle position is reverse or if the orientation of the lead locomotive (L1) is back and the handle position is forward, the train's direction of movement will be from L1 towards L5.

Figure 5:
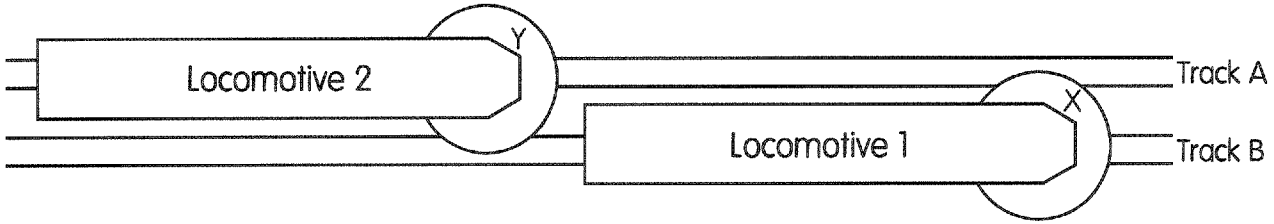
FIG. 5 is a schematic view of a train in an example track network according to principles of the present invention.

In one example, the at least one computer is programmed or configured to receive or determine at least one additional location associated with at least one additional locomotive or control car of at least one additional train in the track network and determine the track of the plurality of tracks on which the train is located based at least partly on the at least one additional location associated with the at least one additional locomotive of the at least one additional train in the track network. For example, an uncertainty in the track location of a train (TR) can be reduced if position reports from locomotives of other trains nearby the train (TR) in the track network are considered in determining the track location of the train (TR). Referring to FIG. 5, the onboard computer 10 of a locomotive (L1) and/or a remote computer, such as, the back office server 23, can determine, based at least partly on the at least one additional location (Position Y in FIG. 5) associated with the at least one additional locomotive (L2) of the at least one additional train in the track network, an amount of skew associated with the at least one location (Position X in FIG. 5) of the at least one locomotive (L1) of the train (TR) (and/or at least one other location of at least one other locomotive (not shown) of the train (TR)), and adjust the at least one location associated with the at least one locomotive L1 (and/or the at least one other location associated with the at least one other locomotive (not shown)) based on the determined skew. For example, still referring to FIG. 5, it may be unclear based on the position information, i.e., Position X, associated with Locomotive 1 whether Locomotive 1 is on track B or track A. The onboard computer 10 of the Locomotive 1 or a remote computer, such as, the back office server 23, can analyze the location information associated with the Locomotive 1 against the location information of one or more other nearby locomotives to determine an amount of skew in the location information of the locomotives, e.g., that the positions associated with Locomotive 1 and the nearby locomotives are skewed in the same direction. Locomotive 2 as shown in FIG. 5 must to be on Track A based on the location information (Position Y) associated therewith and the layout of the tracks A and B. The onboard computer 10 and/or the back office server 23 can determine based on the Position Y and track centerline data for track A that the location information associated with Locomotive 2 (Position Y) is skewed a certain distance and direction from the track centerline of Track A, and determine that the location information associated with Locomotive 1 (Position X) is skewed the same distance and direction, i.e., the same distance and direction that would move Position Y to the centerline of Track A. The onboard computer 10 and/or the back office server 23 can adjust the Position X based on determined distance and direction of the skew to move the location information (Position X) to the centerline of Track B, and determine based on the adjusted location information associated with the Locomotive 1 that the Locomotive 1 is on Track B.

The at least one additional location associated with the at least one additional locomotive of the at least one additional train can comprise a plurality of additional locations associated with the at least one additional locomotive of the at least one additional train over a period of time. For example, the onboard computer 10 of the Locomotive 1 or a remote computer, such as, the back office server 23, can analyze the position information associated with trains in addition to the trains including Locomotive 1 and Locomotive 2 and including additional locomotives on additional tracks to determine an amount of skew associated with the position information and adjust the position information based on the determined skew. The at least one computer may be programmed or configured to identify the at least one additional locomotive of the at least one additional train in the track network based on a distance of the at least one additional locomotive of the at least one additional train from the at least one locomotive of the train. For example, the onboard computer 10 of the Locomotive 1 or a remote computer, such as, the back office server 23, can use a proximity algorithm to find locomotives within a threshold distance, e.g., 1,000 ft., of the initializing locomotive, i.e., Locomotive 1, and the position reports of the locomotives identified to be within the threshold distance can be requested from the locomotives and/or the back office server 23 and analyzed to determine the track location of the Locomotive 1.

In another example, the at least one computer is programmed or configured to determine a position of a switch under the train based at least partly on the at least one location associated with the at least one locomotive and the at least one other location associated with the at least one other locomotive. For example, if the onboard computer 10 of a Locomotive (L1, L2) or a remote computer, such as, the back office server 23, determines that a lead consist is on Main 1 and a rear consist is on Main 2, and there is not an ambiguous route under the train (TR), the onboard computer 10 or the back office server 23 can determine the position of the switches involved, which can improve the safety of the PTC system by enabling the enforcement of any restrictions under the train instead of waiting until the train has traveled its train length.

For example, when there are multiple locomotives or vehicles known to be in the same train or consist, and the position reports of the locomotives or vehicles are used to determine which track those vehicles are on as described herein, if there is a switch between the groups of vehicles, the alignment of the switch can be determined. For example, for three locomotives known to be in the same train and in positions 1, 2, and 3, the position reports of the three locomotives in the same train may be used to determine to determine that those locomotives are on Track A. However, for three other locomotives known to be in the same train at positions 98, 99, and 100, the position reports of the three other locomotives in the same train may be used to determine that the other locomotives are on Track B. If the track database shows that there are no connections between Track A and Track B, an error condition is detected and track selection/direction of travel is discarded. However, if the track database shows two switches connecting Track A and Track B between the positions of the locomotives at the front (1, 2, and 3) and the other locomotives at the rear (98, 99, and 100), the at least one computer can determine the alignment of the two switches to be reverse for each switch, because that is the only possible path based on track selection and the locomotives/vehicles known to be in the same train.

In this manner, provided is an improved system and method for determining a track location and a direction of travel for a train.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system for determining a track location of a train including at least two locomotives or control cars and, optionally, at least one railroad car, in a track network having a plurality of tracks, the system comprising at least one computer programmed or configured to:

receive or determine at least one location associated with at least one locomotive or control car of the train;

receive or determine at least one other location associated with at least one other locomotive or control car, wherein the at least one other locomotive or control car is different than the at least one locomotive or control car, and wherein the at least one other locomotive or control car is in the same train as the at least one locomotive or control car; and determine a track of the plurality of tracks on which the train is located based at least partly on the at least one location associated with the at least one locomotive or control car and the at least one other location associated with the at least one other locomotive or control car.

2. The system of claim 1, wherein the at least one computer is programmed or configured to:

determine a distribution of the at least one location associated with the at least one locomotive or control car and the at least one other location associated with the at least one other locomotive or control car and normalize the distribution to track centerline data; and determine the track of the plurality of tracks on which the train is located based at least partly on the normalized distribution.

3. The system of claim 1, wherein the at least one location associated with the at least one locomotive or control car of the train comprises a plurality of locations associated with the at least one locomotive or control car of the train over a period of time.

4. The system of claim 1, wherein the at least one other locomotive or control car of the train comprises a plurality of other locomotives or control cars of the train, and wherein the at least one other location comprises a plurality of other locations associated with the plurality of other locomotives or control cars of the train over a period of time.

5. The system of claim 1, wherein the at least one locomotive or control car is a lead locomotive, and wherein the at least one computer is programmed or configured to:

receive or determine a direction of orientation of the lead locomotive on the track;

receive or determine a reverser handle position of the lead locomotive; and determine based on the direction of orientation and the reverser handle position a direction of travel of the train on the track.

6. The system of claim 1, wherein the at least one computer is programmed or configured to:

receive or determine at least one additional location associated with at least one additional locomotive or control car of at least one additional train in the track network; and determine the track of the plurality of tracks on which the train is located based at least partly on the at least one additional location associated with the at least one additional locomotive or control car of the at least one additional train in the track network.

7. The system of claim 6, wherein the at least one computer is programmed or configured to:

determine, based at least partly on the at least one additional location associated with the at least one additional locomotive or control car of the at least one additional train in the track network, an amount of skew associated with the at least one location of the at least one locomotive or control car of the train and/or the at least one other location of the at least one other locomotive or control car of the train; and adjust the at least one location associated with the at least one locomotive or control car and/or the at least one other location associated with the at least one other locomotive or control car based on the determined skew.

8. The system of claim 6, wherein the at least one additional location associated with the at least one additional locomotive or control car of the at least one additional train comprises a plurality of additional locations associated with the at least one additional locomotive or control car of the at least one additional train over a period of time.

9. The system of claim 6, wherein the at least one computer is programmed or configured to:

identify the at least one additional locomotive or control car of the at least one additional train in the track network based on a distance of the at least one additional locomotive or control car of the at least one additional train from the at least one locomotive or control car of the train.

10. The system of claim 1, wherein the track of the plurality of tracks on which the train is located comprises a first track connected to a second track by at least one switch, and wherein the at least one computer is programmed or configured to:

determine an alignment of the at least one switch based at least partly on a position of the at least one first locomotive or control car in the train, a position of the at least one second locomotive or control car in the train, the at least one location associated with the at least one locomotive or control car, and the at least one other location associated with the at least one other locomotive or control car.

11. The system of claim 1, wherein the at least one computer comprises an onboard computer of the at least one locomotive or control car, the onboard computer programmed or configured to:

transmit a query message to at least one of (i) the least one other locomotive or control car of the train and (ii) a back office server, the query message requesting a locomotive position report message including the at least one other location associated with at least one other locomotive or control car of the train.

12. The system of claim 1, further comprising a positioning system onboard the at least one locomotive or control car of the train, the positioning system comprising a Global Positioning System (GPS) programmed or configured to determine the at least one location associated with at least one locomotive or control car of the train.

13. A system for determining a direction of travel of a train including at least two locomotives or control cars and, optionally, at least one railroad car, in a track network having a plurality of tracks, the system comprising at least one computer programmed or configured to:

receive or determine a direction of orientation of a lead locomotive of the train on a track before the train moves after an initialization of the lead locomotive or control car;

receive or determine a reverser handle position of the lead locomotive of the train before the train moves after the initialization of the lead locomotive or control car; and determine, based on the direction of orientation and the reverser handle position, the direction of travel of the train on the track before the train moves after the initialization of the lead locomotive or control car.

14. The system of claim 13, further comprising:

a reverser handle on the lead locomotive of the train, wherein the reverser handle is configured to move between a forward handle position and a reverse handle position;

wherein the at least one computer includes an onboard computer on the lead locomotive, and wherein the onboard computer is programmed or configured to automatically determine the reverser handle position of the lead locomotive of the train according to a handle position of the reverser handle.

15. A computer implemented method for determining a track location of a train including at least two locomotives or control cars and, optionally, at least one railroad car, in a track network having a plurality of tracks, the method comprising:

receiving or determining at least one location associated with at least one locomotive or control car of the train;

receiving or determining at least one other location associated with at least one other locomotive or control car, wherein the at least one other locomotive or control car is different than the at least one locomotive or control car, and wherein the at least one other locomotive or control car is in the same train as the at least one locomotive or control car; and determining a track of the plurality of tracks on which the train is located based at least partly on the at least one location associated with the at least one locomotive or control car and the at least one other location associated with the at least one other locomotive or control car.

16. A computer implemented method for determining a direction of travel of a train including at least two locomotives or control cars and, optionally, at least one railroad car, in a track network having a plurality of tracks, the method comprising:

receiving or determining a direction of orientation of a lead locomotive of the train on the track before the train moves after an initialization of the lead locomotive or control car;

receiving or determining a reverser handle position of the lead locomotive of the train before the train moves after the initialization of the lead locomotive or control car; and determining based on the direction of orientation and the reverser handle position the direction of travel of the train on the track before the train moves after the initialization of the lead locomotive or control car.

17. A system for determining a track location of a train including at least one locomotive or control car and, optionally, at least one railroad car, in a track network having a plurality of tracks, the system comprising at least one computer programmed or configured to:

receive or determine at least one location associated with the at least one locomotive or control car of the train;

receive or determine at least one additional location associated with at least one additional locomotive or control car of at least one additional train in the track network, wherein the at least one additional locomotive or control car is different than the at least one locomotive or control car, and wherein the at least one additional train in the track network is different than the train in the track network;

receive or determine track centerline data associated with a centerline of a track of the plurality of tracks on which the at least one additional train is located;

determine, based on the at least one additional location associated with the at least one additional locomotive or control car of the at least one additional train in the track network and the track centerline data, an amount of skew associated with the at least one additional location of the at least one additional locomotive or control car of the at least one additional train;

adjust the at least one location associated with the at least one locomotive or control car of the train based on the amount of skew associated with the at least one additional location; and determine a track of the plurality of tracks on which the train is located based at least partly on the adjusted at least one location associated with the at least one locomotive or control car of the train.

18. The system of claim 17, wherein the at least one additional location associated with the at least one additional locomotive or control car of the at least one additional train comprises a plurality of additional locations associated with the at least one additional locomotive or control car of the at least one additional train over a period of time.

19. The system of claim 17, wherein the at least one additional locomotive or control car of the at least one additional train comprises a plurality of additional locomotives or control cars.

20. The system of claim 17, wherein the at least one computer is programmed or configured to:

identify the at least one additional locomotive or control car of the at least one additional train in the track network based on a distance of the at least one additional locomotive or control car of the at least one additional train from the at least one locomotive of the train.

21. The system of claim 17, wherein the train comprises at least one other locomotive or control car, wherein the at least one other locomotive or control car is different than the at least one locomotive or control car, and wherein the at least one other locomotive or control car is in the same train as the at least one locomotive or control car, and wherein the at least one computer is programmed or configured to:

receive or determine at least one other location associated with the at least one other locomotive or control car of the train; and determine the track of the plurality of tracks on which the train is located based at least partly on the at least one other location associated with the at least one other locomotive or control car.

22. The system of claim 17, wherein the at least one computer comprises an onboard computer of the at least one locomotive or control car, the onboard computer programmed or configured to:

transmit a query message to at least one of (i) the least one additional locomotive or control car of the at least one additional train in the track network and (ii) a back office server, the query message requesting a locomotive position report message including the at least one additional location associated with at least one additional locomotive or control car of the at least one additional train.

23. The system of claim 17, further comprising a positioning system onboard the at least one locomotive or control car of the train, the positioning system comprising a Global Positioning System (GPS) programmed or configured to determine the at least one location associated with at least one locomotive or control car of the train.

24. A computer implemented method for determining a track location of a train including at least one locomotive or control car and, optionally, at least one railroad car, in a track network having a plurality of tracks, the method comprising:

receiving or determining at least one location associated with the at least one locomotive or control car of the train;

receiving or determining at least one additional location associated with at least one additional locomotive or control car of at least one additional train in the track network, wherein the at least one additional locomotive or control car is different than the at least one locomotive or control car, and wherein the at least one additional train in the track network is different than the train in the track network;

receiving or determining track centerline data associated with a centerline of a track of the plurality of tracks on which the at least one additional train is located;

determining, based on the at least one additional location associated with the at least one additional locomotive or control car of the at least one additional train in the track network and the track centerline data, an amount of skew associated with the at least one additional location of the at least one additional locomotive or control car of the at least one additional train;

adjusting the at least one location associated with the at least one locomotive or control car of the train based on the amount of skew associated with the at least one additional location; and determining a track of the plurality of tracks on which the train is located based at least partly on the adjusted at least one location associated with the at least one locomotive or control car of the train.

* * * * *